US006971451B2

(12) United States Patent
Schmieg

(10) Patent No.: US 6,971,451 B2
(45) Date of Patent: Dec. 6, 2005

(54) FIREFIGHTING PENETRATION TOOL

(76) Inventor: Joel T. Schmieg, 210 Lakeway Trails, McKinney, TX (US) 75069

( * ) Notice: Subject to any disclaimer, the term of this patent is extended or adjusted under 35 U.S.C. 154(b) by 45 days.

(21) Appl. No.: 10/615,155

(22) Filed: Jul. 8, 2003

(65) Prior Publication Data

US 2005/0006108 A1 Jan. 13, 2005

(51) Int. Cl.[7] ..... A62C 11/00
(52) U.S. Cl. ..... 169/70; 169/51; 239/271; 239/272
(58) Field of Search ..... 169/51, 67, 70; 239/271, 272

(56) References Cited

U.S. PATENT DOCUMENTS

| | | | | | |
|---|---|---|---|---|---|
| 551,527 | A | * | 12/1895 | Cunningham | 239/271 |
| 1,106,679 | A | * | 8/1914 | Randall | 239/271 |
| 1,377,431 | A | | 5/1921 | Pfeil | |
| 1,758,119 | A | | 5/1930 | Moon | |
| 1,756,582 | A | | 12/1930 | Butler | |
| 1,991,930 | A | * | 2/1935 | Hope | 111/7.1 |
| 2,413,083 | A | | 12/1946 | Snowden et al. | 299/100 |
| 2,756,829 | A | | 7/1956 | Phillips | 169/2 |
| 2,813,753 | A | | 11/1957 | Roberts | 299/110 |
| 2,967,570 | A | | 1/1961 | Nurkiewicz | 169/1 |
| 2,993,650 | A | * | 7/1961 | Badberg | 239/27 |
| 3,026,827 | A | * | 3/1962 | Cunningham | 111/7.1 |
| 3,045,761 | A | | 7/1962 | Ciarlo | 169/31 |
| 3,082,681 | A | * | 3/1963 | Petersen | 141/329 |
| 3,140,720 | A | | 7/1964 | Griswold | 137/59 |
| 3,606,166 | A | * | 9/1971 | Whear | 239/272 |
| 3,820,606 | A | * | 6/1974 | Terayama | 239/271 |
| 4,170,948 | A | * | 10/1979 | Strickland, Jr. | 111/7.1 |
| 4,219,084 | A | | 8/1980 | Gray et al. | 169/70 |
| 4,625,808 | A | | 12/1986 | Halfpenny | 169/30 |
| 4,676,319 | A | | 6/1987 | Cuthbertson | 169/70 |
| 4,697,740 | A | | 10/1987 | Ivy | 239/271 |
| 4,802,535 | A | | 2/1989 | Bakke | 169/70 |
| 5,062,486 | A | * | 11/1991 | McClenahan | 169/70 |
| 5,253,716 | A | | 10/1993 | Mitchell | 169/70 |
| 5,540,284 | A | | 7/1996 | Esposito et al. | 169/62 |
| 6,398,136 | B1 | * | 6/2002 | Smith | 169/70 |
| 6,561,281 | B1 | * | 5/2003 | Arnold | 169/43 |
| 6,668,939 | B2 | * | 12/2003 | Schmidt et al. | 169/70 |

* cited by examiner

*Primary Examiner*—Dinh Q. Nguyen
(74) *Attorney, Agent, or Firm*—Michael Diaz

(57) ABSTRACT

A firefighting penetration tool for penetrating a surface and ejecting a fluid into an area on fire. The firefighting tool includes a weighted head, a planar surface area affixed to the weighted head and an interchangeable penetrating body projecting from the planar surface area. The penetrating body has a chamber leading to a plurality of apertures. A hollow handle extends from the weighted head. The hollow handle is connected to a hose connected to an extinguishing agent supply, such as a fire truck. The penetrating body is used for piercing a surface. The extinguishing agent supply pumps fluid through the hose into the handle and ejects fluid through the plurality of apertures.

16 Claims, 4 Drawing Sheets

FIREFIGHTING PENETRATION TOOL

BACKGROUND OF THE INVENTION

1. Technical Field of the Invention

This invention relates to firefighting equipment, and more particularly, to a firefighting penetrating apparatus.

2. Description of Related Art

There are many firefighting devices in use to combat fires. Some of the most common types of equipment used in combating fires include fire hoses and fire extinguishers. Fire hoses and extinguishers utilize water or some chemicals to smother a fire. However, it is oftentimes difficult for a firefighter to reach areas because of obstructions. Another common existing device used to combat fires is a battering ram device having a nozzle extension. The battering ram is smashed into a surface, from which water or chemicals are ejected into a desired area. Although this battering ram device is helpful in fighting some fires, there are several disadvantages. The battering ram merely utilizes a radial stream or a straight single stream for ejecting the water or chemicals. In addition, the battering ram device is not conducive for enabling only one person to penetrate a surface. Since the battering ram is not swung, but rather pushed into a surface, the weight of the ram is not effectively used to apply a large amount of force to pierce a desired surface. The battering ram device also does not limit the depth of penetration of the ram through the surface. Therefore, the depth cannot be set to optimize the efficiency of the stream coming from the nozzle. In addition, the ram may penetrate into an area where damage is not desired. For example, if such a battering ram is utilized in penetrating a hood of a car to combat an engine fire, the battering ram may very well penetrate into the engine, thereby causing significant damage to the car. A device is needed which provides a plurality of streams in multiple directions to combat a fire. The device must be capable of being utilized by one person to penetrate a surface. Finally, the device must be limited in its depth of penetration to optimize nozzle stream efficiency and reduce damage to a desired area.

Although there are no known prior art teachings of an apparatus such as that disclosed herein, prior art references that discuss subject matter that bears some relation to matters discussed herein are U.S. Pat. No. 4,802,535 to Bakke (Bakke), U.S. Pat. No. 5,062,486 to McClenahan (McClenahan), U.S. Pat. No. 5,253,716 to Mitchell (Mitchell), and U.S. Pat. No. 5,540,284 to Esposito et al. (Esposito).

Bakke discloses a firefighting tool which has a perforated pointed end. The point includes rearwardly directed ports which are arranged to produce non-intersecting streams of water. These ports emit water under high pressure when the pointed end is attached to a fire hose. However, Bakke does not allow the device to be swung into a surface. The device disclosed in Bakke must be pushed into the surface, which reduces the amount of force available to penetrate a surface. In addition, Bakke does not teach or suggest a stop to set the amount of penetration by the device into a surface.

McClenahan discloses a firefighter's barrier penetrator and agent injector which has an extending slide rod to guide a slide hammer to strike a penetrating body. The slide rod may be retracted into the body to minimize the length of the penetrator while being carried. A nozzle is slidably mounted in the body to be extendible into the structure for injection purposes, again to minimize the carrying length. However, McClenahan does not teach or suggest a penetrating device which limits the distance of penetration. Additionally, McClenahan merely discloses a battering ram-type device, which prevents the device from being swung into a surface, which minimizes the force applied in penetrating the surface. In addition, McClenahan merely discloses a device which provides a plurality of streams in very limited directions.

Mitchell discloses a firefighting tool which produces a fog through a nozzle. The nozzle includes a plurality of apertures oriented so that when pressurized fluid flows through each aperture, the liquid impacts at an angle of 90 degrees with another stream of liquid to atomize the liquid and create a fog. However, Mitchell does not teach or suggest a device which allows a firefighter to swing the device to assist in penetrating the surface. In addition, Mitchell does not disclose a stop to set the amount of penetration by the tool.

Esposito discloses a portable, hand-held firefighting tool connected by a hose to a large source of fire extinguishing agent. This tool includes a hollow, penetrating body having a sharp cutting element connected to the body. The body is connected to a hollow, linear handle having any angle between a longitudinal line from the body to the handle of between 45 degrees and 135 degrees. A hose is connected to a penetrating body having a pointed end. Esposito does not teach or suggest a nozzle having a plurality of streams in a plurality of axes. Rather, Esposito merely discloses a nozzle which produces a radial stream, which is not as effective in combating a fire as multiple streams in a plurality of axes. In addition, Esposito does not teach or suggest a device which sets the amount of penetration of the penetrating body to a specified depth to maximize the efficiency of the nozzle stream and prevent excessive damage of items located beyond a penetrated surface.

Review of the foregoing references reveals no disclosure or suggestion of a firefighting tool which allows a person to easily penetrate a surface while setting the depth of penetration of the tool to maximize efficiency of a nozzle stream and without causing excessive damage. In addition, no existing device discloses providing maximum effectiveness and efficiency in utilizing a plurality of streams of fluid to combat a fire. It is the object of the present invention to provide such an apparatus.

SUMMARY OF THE INVENTION

In one aspect, the present invention is a firefighting penetration tool. The firefighting penetration tool includes a weighted head, a planar surface affixed to the weighted head, and a penetrating body projecting from the planar surface area. The penetrating body may be interchangeable with other penetrating bodies. The penetrating body has a chamber leading to a plurality of apertures. A hollow handle extends from the weighted head. The penetrating body is used to pierce a surface. In addition, the hollow handle is connected to a hose, which, in turn, is connected to a fluid supply. The fluid supply pumps fluid through the hose into the hollow handle and ejects fluid through the plurality of apertures. The fluid may be any extinguishing agent utilized for combating a fire.

In another aspect, the present invention is a firefighting penetration tool having a weighted head, a planar surface area affixed to the weighted head, and a penetrating body projecting from the planar surface area. The penetrating body has a chamber leading to a plurality of apertures. The penetrating body has a pointed end and an opposite threaded end for retention in the planar surface area. The penetrating body has a plurality of rows. Each row has a plurality of apertures ejecting the fluid outwardly in a plurality of axes.

The tool also includes a hollow handle extending from the weighted head and a shutoff valve for restricting the flow of the fluid into the handle. The weighted head weighs more than the weight of the handle. The penetrating body is utilized to pierce a surface. The hollow handle is connected to a hose, which, in turn, is connected to a fluid supply. The fluid supply pumps fluid through the hose into the hollow handle and ejects fluid through the plurality of apertures.

In still another aspect, the present invention is a firefighting penetration system having a weighted head, a planar surface area affixed to the weighted head, and a penetrating body projecting from the planar surface area. The penetrating body has a chamber leading to a plurality of apertures. In addition, a hollow handle extends from the weighted head. The system also includes a hose connected to the handle and a fluid supply pumping fluid through the hose. The penetrating body is used to pierce a surface. The fluid supply pumps fluid through the hose into the hollow handle and ejects fluid through the plurality of apertures.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
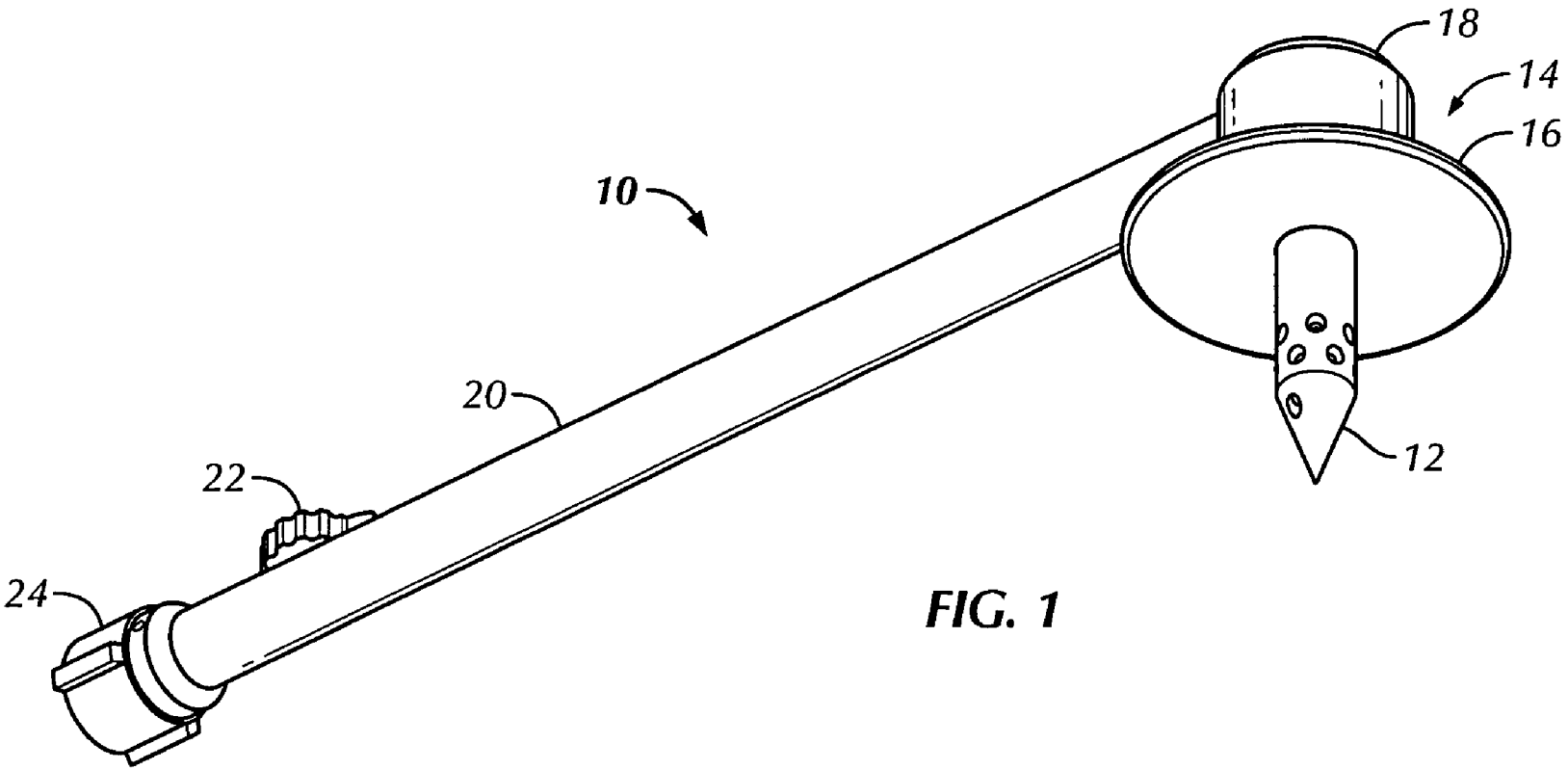
FIG. 1 is a front perspective view of a penetrating tool in the preferred embodiment of the present invention.

A firefighting tool for penetrating a surface a specified depth is disclosed. FIG. 1 is a front perspective view of a penetrating tool 10 in the preferred embodiment of the present invention. The penetrating tool includes a penetrating body 12 removably affixed to a weighted head 14. Preferably, the penetrating body is shaped with a pointed end allowing easier penetration into a surface. The weighted head 14 includes a planar surface area 16 and a weight 18 affixed to a backside 20 of the planar surface area. The planar surface area is an area larger than the penetrating body. The planar surface area may be any size or shape which may be utilized to prevent passage of the planar surface area and weighted head through a penetrated surface by the penetrating tool. A handle 20 projects outwardly from the weighted head. The handle includes a shutoff valve 22. At an opposite end of the handle from the weighted head 14 is a coupling mechanism 24. The penetrating tool may be constructed of any sturdy material, such as a heavy duty steel. Additionally, the weighted head preferably weighs more than the weight of the handle.

Figure 2:
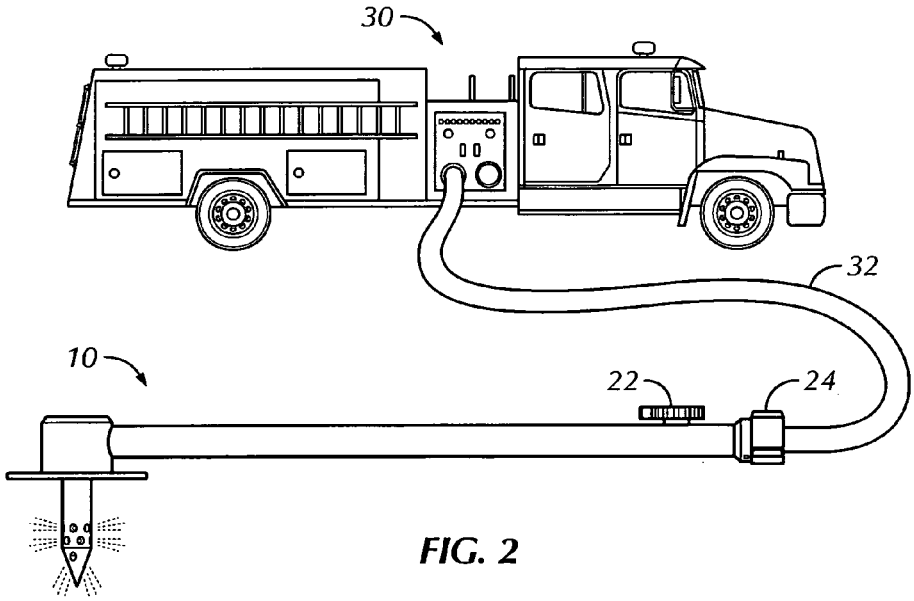
FIG. 2 is a front perspective view of the penetrating tool attached to a fire truck.

FIG. 2 is a front perspective view of the penetrating tool 10 attached to a fire truck 30. The penetrating tool may be coupled through the coupling mechanism 24 to any type of conventional fire hose 32. The conventional fire hose is connected to the fire truck. The fire truck pumps an extinguishing agent such as water or chemicals through the fire hose into the penetrating tool 10. In alternate embodiments of the present invention, the coupling mechanism may be any device that secures a fluid supply through the handle 20, such as a quick connect mechanism.

Figure 3:
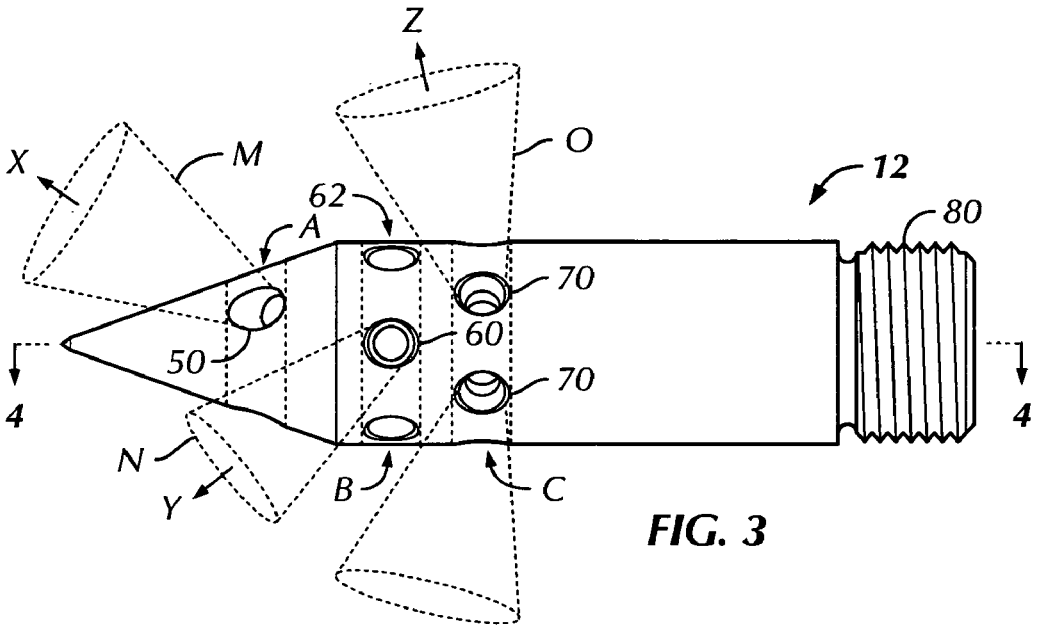
FIG. 3 is a side view of the penetrating body removed from the weighted head.

FIG. 3 is a side view of the penetrating body 12 removed from the weighted head 14. The penetrating body includes a row A of a plurality of apertures, a row B of a plurality of apertures, and a row C of a plurality of apertures. In FIG. 3, an aperture 50 in row A is illustrated. In row B, an aperture 60 is illustrated in a circumferential configured groove 62. In row C, apertures 70 are illustrated. The penetrating body also includes a threaded end 80. Each row produces a spray in a different axis to provide a larger coverage area when attempting to extinguish a fire. For example, in row A, the apertures 50 may produce a stream M in an axis X. In row B, the apertures 60 direct the fluid to produce a stream N in an axis Y. In row C, the apertures 70 direct the fluid to produce a stream O in an axis Z. The direction of each stream may be set by utilizing radiused apertures, flutes, or other means for diverting or disrupting the stream or directing the stream in a desired direction and spray pattern. In addition, the circumferential groove may be orientated in any direction, such as longitudinally along the length of the penetrating body. The illustration of the direction and size of each stream is merely illustrative. It should be understood that the pattern and direction of the streams may be in a direction and magnitude which provides a plurality of axes. Maximum efficiency and effectiveness of the streams are utilized to combat a fire. In addition, in alternate embodiments of the present invention, there may be one, two or more rows having a plurality of apertures. The use of a plurality of stream axes provides an effective way of combating a fire.

The apertures may be configured in any fashion to provide a plurality of streams for combating a fire. Grooves, slots, channels, flutes or other configurations may be used to assist in diverting a plurality of streams in desired directions. In addition, the apertures may be configured in such a manner to divert the stream or change the spray pattern. For example, slots, radiused holes, counter bores, chamfers, offset chamfers, spot-faced holes, threaded, or any other shape may be used.

The penetrating body may include a relatively long length with an aperture at an end of the penetrating body for use when combating fires through windows or other difficult to access areas. In addition, the penetrating body may be approximately up to 5 feet with apertures located throughout an outer surface of the penetrating body (especially useful for hay bale fires).

Figure 4:
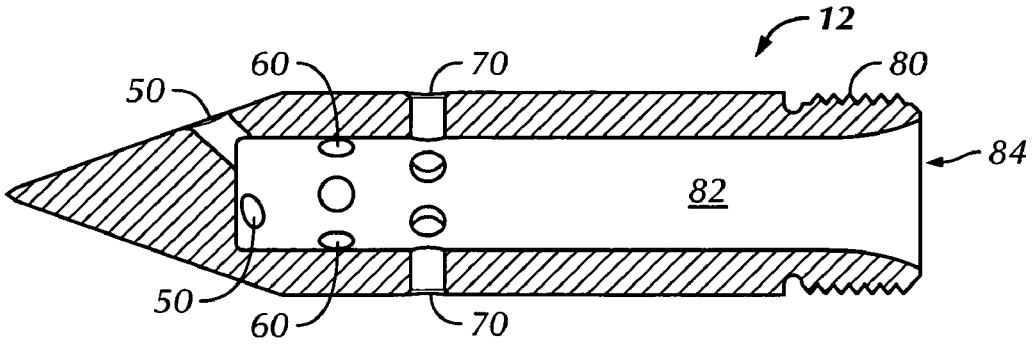
FIG. 4 is a cross sectional view of the penetrating body of FIG. 3 taken along line 4—4 of FIG. 3.

FIG. 4 is a cross sectional view of the penetrating body 12 of FIG. 3 taken along line 4—4 of FIG. 3. The penetrating body includes a hollow chamber 82 leading to the plurality of apertures. Within the threaded end 80 is an opening 84 leading to the chamber 82.

Figure 5:
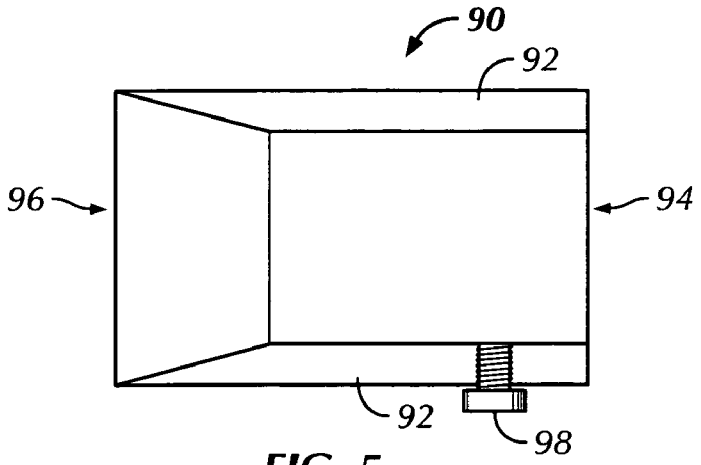
FIG. 5 is a side view of a straight stream adapter in an alternate embodiment of the present invention.
Figure 6:
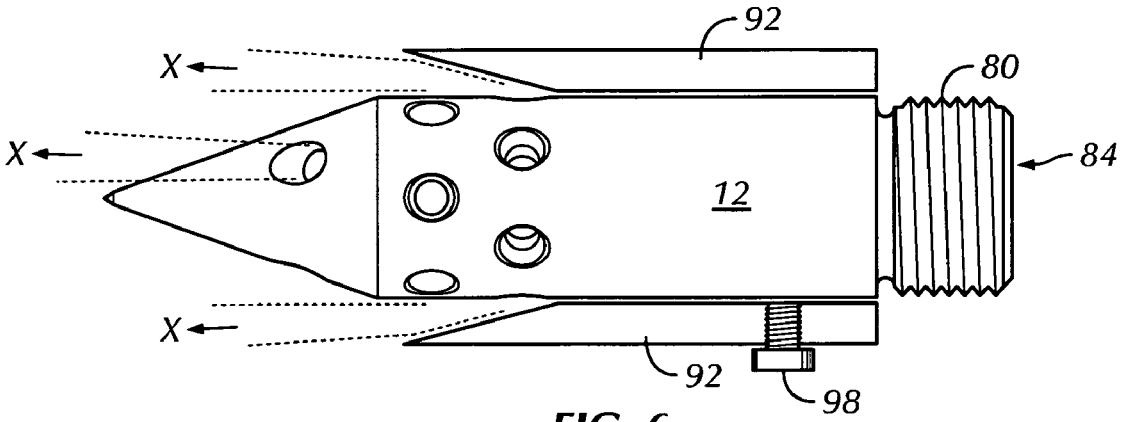
FIG. 6 is a side view of the straight stream adapted affixed to the penetrating body.

FIG. 5 is a side view of a straight stream adapter 90 which may be positioned and affixed around the penetrating body 12 in an alternate embodiment of the present invention. FIG. 6 is a side view of the straight stream adapter affixed to the penetrating body. The straight stream adapter includes a wall 92 circularly configured to fit around the penetrating body 12. The adapter includes an opening 94 and an outlet opening 96. The adapter may be positioned upon the penetrating body and held in position by a retaining knob/screw mechanism 98. Any retaining mechanism may be used to retain the mechanism 98 to the penetrating body. The adapter allows a modified or a straight stream to be ejected from the penetrating tool. It should be understood by those skilled in the art that any type of diverting device may be utilized which diverts a stream or streams into one general axis.

With reference to FIGS. 1–6, the operation of the penetrating tool 10 will now be explained. The penetrating tool is attached to the fire hose 32. The fire hose 32 is connected to a fire truck or other water/fluid source. The penetrating tool may be connected in any manner providing a water tight connection. In the preferred embodiment of the present invention, the penetrating tool may be connected by the coupling mechanism 24 which includes a threaded collar (female member) which connects to a male member attached to the fire hose. The penetrating tool includes a weighted head having a weight greater than the remaining portion of the handle. The distribution of weight on the penetrating tool enables an individual to easily swing the penetrating tool into a surface. In addition, the weighted head provides a solid surface area which may be hit with a hammer or other device to assist in penetrating a surface.

As the penetrating tool 10 penetrates a surface, the penetrating tool is limited in the depth that it may penetrate by the planar surface area 16. Since the planar surface area is a larger surface area than the penetrating body 12, only the penetrating body penetrates the surface while the remainder of the penetrating tool remains on the exterior side of the surface. Thus, the depth of the penetrating body is set to optimize the stream within an enclosed area. If the penetrating body were allowed to completely penetrate the surface, the penetrating body would emit a stream which may not effectively cover the fire area. In addition, the planar surface area, with the penetrating body, is used to plug the hole created by the penetrating body. By plugging the hole, oxygen is effectively prevented from entering the enclosed area. By preventing the introduction of air into a fire, the fire is prevented from growing. Since the penetrating tool merely penetrates the length of the penetrating body, damage to an item located within an interior of the penetrated surface is also minimized. The use of the planar surface area upon the penetrating tool provides a unique feature in preventing unnecessary damage. For example, if a firefighter is swinging the penetrating tool into a hood of a burning car, the penetrating tool only allows limited penetration of the penetrating body into the motor compartment. Thus, damage to the motor compartment is minimized while still allowing the penetrating body to spray fluid into the motor compartment.

Fluid is pumped through the fire hose 32 into the penetrating tool. Fluid may be defined as any extinguishing agent such as water, fluid, foam, or any chemical or chemicals (dry or wet) which may be used to combat a fire. For simplicity, water will be considered the fluid utilized. However, it should be understood that any fluid or chemical may be pumped into the penetrating tool. The water is pumped through the opening 84 and into the hollow chamber 82 where it is ejected out the plurality of apertures. As discussed above, there are a plurality of rows of apertures providing spray patterns in a plurality of axes. The plurality of axes provide an effective and novel way of spraying water into a desired area. Existing devices merely utilize a radial stream which may not provide enough spray pattern to extinguish a fire. In addition, existing devices do not optimized the depth of penetration to maximize the efficiency of the nozzle stream. Apertures 50 of row A provide a spray pattern X in the axis M. Apertures 60 of row B provide a spray pattern N in the Y axis. Apertures 70 provide a spray pattern O in the Z axis. The spray pattern and direction of the spray may be set by the shape and size of each aperture.

Once the penetrating body has penetrated a surface, the water may be ejected through the hollow chamber 82 and through the plurality of apertures to douse the fire. The water flow may be shut off as desired by the firefighter by actuation of the optional shutoff valve. The optional shutoff valve is preferably located on the penetrating tool 10 to allow the firefighter to readily turn off or on the water flow as desired. In an alternate embodiment of the present invention, the shutoff valve may be located at the fluid supply (e.g., truck) or on a hose.

In situations where a straight stream pattern is beneficial in combating a fire, the straight stream adapter 90 may be utilized. The straight stream adapter diverts the outgoing streams into one axis, such as the X axis. The outer wall 92 diverts the outflow from the apertures into one axis. The straight stream adapter is positioned on the penetrating body as shown in FIG. 6. The retaining knob/screw mechanism 98 is used for retaining the straight stream adapter onto the penetrating body. The straight stream adapter is appropriate for hard to reach areas requiring a straight stream, such as under the floor of a burning house. The penetrating tool, in such a configuration, is not used for penetrating a surface, but rather an extension for emitting a modified or straight stream.

The penetrating body is interchangeable with other penetrating bodies having different lengths or spray patterns. In the preferred embodiment of the present invention, the penetrating body includes a threaded end 80 which is threaded into a receiver (not shown) on the planar surface area 16. The penetrating body may be removed by twisting the penetrating body out of the receiver. A second penetrating body may then be twisted into position on the weighted head 14. In addition, in an alternate embodiment of the present invention, the penetrating body may be other than a pointed tip, such as a triangular or an axe shape.

Figure 7:
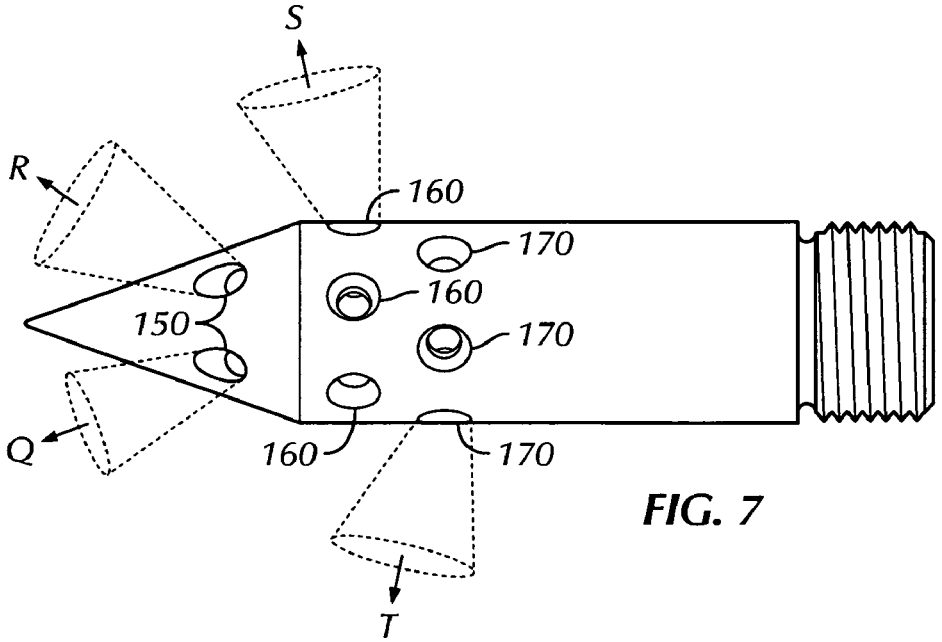
FIG. 7 is a side view of the penetrating body removed from the weighted head in an alternate embodiment of the present invention.

FIG. 7 is a side view of the penetrating body 112 removed from the weighted head 114 in an alternate embodiment of the present invention. The penetrating body 112, in a similar manner to penetrating body 12, includes a plurality of apertures 150, 160 and 170 having streams R, Q, S, and T. Some or all of the apertures may be located within a V groove 180. The V groove may divert the stream Q in a different direction and spray pattern than shown in stream R. Alternatively, the V grooves may be located in several locations along the length of the nozzle.

The penetrating tool provides many advantages over existing devices. The penetrating tool enables a firefighter to easily penetrate a surface. The unique weight distribution allows the firefighter to swing the penetrating tool into a surface with a tremendous force. The penetrating tool is also set to a specific depth to maximize the efficiency of the nozzle streams. In addition, the penetrating tool, through the use of the planar surface area, prevents excessive damage beyond the penetrated surface. The penetrating tool also provides a unique spray pattern in a plurality of axes to provide fuller and more effective coverage in extinguishing a fire. Additionally, the penetrating tool may interchange penetrating bodies to suit specific situations. The penetrating tool may be used to effectively fight fires in enclosures, as well as areas where a surface must be pierced (e.g., burning car, burning house, etc.). The penetrating tool may also be used as an extension to provide the fluid to hard to reach areas, such as through windows, under houses, etc.

It is thus believed that the operation and construction of the present invention will be apparent from the foregoing description. While the apparatus shown and described has been characterized as being preferred, it will be readily apparent that various changes and modifications could be made therein without departing from the scope of the invention as defined in the following claims.

What is claimed is:

1. A firefighting penetration tool, said penetration tool comprising:

a weighted head;

a planar surface area affixed to said weighted head;

a penetrating body projecting from said planar surface area, said penetrating body having a chamber leading to a plurality of apertures; and a hollow handle extending from said weighted bead;

said penetrating body projecting approximately perpendicularly out from said handle;

whereby said penetrating body pierces a surface and said hollow handle is connected to a hose connected to a fluid supply, the fluid supply pumping fluid through the hose into the hollow handle to the chamber and ejecting fluid through the plurality of apertures, said planar surface area limiting penetration of said penetrating body to a specified depth within the surface.

2. The firefighting penetration tool of claim 1 wherein said penetrating body is removable from said planar surface and interchangeable with a second penetrating body.

3. The firefighting penetration tool of claim 2 wherein said penetrating body includes a threaded end and said planar surface includes a threaded receiver for retaining said penetrating body, whereby a plurality of penetrating bodies may he interchanged into the penetration tool.

4. The firefighting penetration tool of claim 1 wherein said handle includes a connection mechanism on one end of the handle for connecting said handle to the hose.

5. The firefighting penetration tool of claim 1 wherein said penetrating body includes a pointed end for penetrating a surface.

6. The firefighting penetration tool of claim 1 wherein said penetrating body includes a plurality of rows, each row having a plurality of apertures ejecting the fluid outward in a plurality of axes.

7. The firefighting penetration tool of claim 6 wherein said penetrating body includes a groove located on said penetrating body to disrupt flow of the fluid through at least one aperture.

8. The firefighting penetration tool of claim 7 wherein the groove is located circumferentially around said penetrating body.

9. The firefighting penetration tool of claim 7 wherein the groove is located longitudinal along a length of said penetrating body.

10. The firefighting penetration tool of claim 1 wherein said handle includes a shutoff valve for restricting the flow of the fluid into said handle.

11. The firefighting penetration tool of claim 1 wherein said weighted head is configured to weigh more than the weight of the remainder of said handle.

12. The firefighting penetration tool of claim 1 further comprising a removable straight stream adapter sized and shaped to surround said penetrating body, whereby said straight stream adapter diverts ejected fluid into a desired stream.

13. The firefighting penetration tool of claim 12 wherein said straight stream adapter is retained onto said penetrating body by a retaining knob/screw mechanism.

14. A firefighting penetration tool, said penetration tool comprising:

a weighted head;

a planar surface area affixed to said weighted bead;

a penetrating body projecting from said planar surface area, said penetrating body having a chamber leading to a plurality of apertures, said penetrating body having a pointed end and an opposite threaded end for retention in said planar surface area;

said penetrating body having a plurality of rows, each row having a plurality of apertures ejecting the fluid outward in a plurality of axes;

a hollow handle extending from said weighted head; and a shutoff valve for restricting the flow of the fluid into said handle;

said weighted head being configured to weigh more than a weight of said handle;

said penetrating body projecting approximately perpendicularly out from said handle;

whereby said penetrating body pierces a surface and said hollow handle is connected to a hose connected to a fluid supply, the fluid supply pumping fluid through the hose into the hollow handle to the chamber and ejecting fluid through the plurality of apertures, said planar surface area limiting penetration of said penetrating body to a specified depth within the surface.

15. A firefighting penetration system, said penetration system comprising:

a weighted head;

a planar surface area affixed to said weighted head;

a penetrating body projecting from said planar surface area, said penetrating body having a chamber leading to a plurality of apertures;

a hollow handle extending from said weighted head;

said penetrating body projecting approximately perpendicularly out from said handle;

a hose connected to said handle; and a fluid supply pumping fluid through said hose;

whereby said penetrating body pierces a surface and said fluid supply pumps fluid through the hose into the hollow handle to the chamber and ejects fluid through the plurality of apertures, said planar surface area limiting penetration of said penetrating body to a specified depth within the surface.

16. The firefighting penetration system of claim 15 wherein said penetrating body includes at least one groove having at least one aperture, the groove diverting a stream of fluid ejected trough the one aperture.

* * * * *